US005328765A

United States Patent [19]

Anderson et al.

[11] Patent Number: 5,328,765

[45] Date of Patent: Jul. 12, 1994

[54] ORGANIC POLYMERS HAVING A MODIFIED SURFACE AND PROCESS THEREFOR

[75] Inventors: Norman S. Anderson; Albert L. Promislow, both of Charlotte, N.C.

[73] Assignee: Hoechst Celanese Corporation, Somerville, N.J.

[21] Appl. No.: 951,147

[22] Filed: Sep. 28, 1992

Related U.S. Application Data

[63] Continuation of Ser. No. 532,048, May 25, 1990, abandoned, which is a continuation-in-part of Ser. No. 344,724, Apr. 28, 1989.

[51] Int. Cl.[5] ..... D02G 3/00

[52] U.S. Cl. ..... 428/364; 428/375; 428/395; 8/115.6; 8/115.54; 8/115.56

[58] Field of Search ..... 428/364, 395, 375; 8/115.6, 115.56, 115.64, 115.69, 115.65

[56] References Cited

U.S. PATENT DOCUMENTS

| | | | |
|---|---|---|---|
| 3,678,098 | 7/1972 | Lewis et al. | 260/89.5 |
| 4,200,562 | 4/1980 | Yoshioka et al. | 260/29.6 |
| 4,317,736 | 2/1982 | Marshall | 428/395 |
| 4,420,583 | 12/1983 | Hutton | 524/501 |
| 4,438,178 | 3/1984 | Powers | 428/289 |
| 4,751,143 | 6/1988 | Gibbon et al. | 428/395 |
| 4,880,906 | 11/1989 | Esselborn et al. | 528/403 |
| 4,933,236 | 6/1990 | Anderson et al. | 428/395 |

FOREIGN PATENT DOCUMENTS

| | | | |
|---|---|---|---|
| 876684 | 7/1971 | Canada . | |
| 0395435 | 10/1990 | European Pat. Off. . | |
| 1103923 | 4/1961 | Fed. Rep. of Germany . | |
| 62-149913 | 7/1987 | Japan | 428/394 |
| 1140528 | 1/1969 | United Kingdom . | |
| 1156624 | 7/1969 | United Kingdom . | |
| 1162810 | 8/1969 | United Kingdom . | |

*Primary Examiner*—Patrick J. Ryan
*Assistant Examiner*—J. M. Gray
*Attorney, Agent, or Firm*—Philip P. McCann

[57] ABSTRACT

Organic polymer surfaces are modified by contacting such surfaces with a halohydroxy compound and a cationic compound of an acid having a $pK_a > 2.5$. Preferably the organic polymer is selected from the group consisting of polyesters, aromatic polyamides, polyimides, and graphitic polymers and the contacting is conducted at an elevated temperature.

10 Claims, No Drawings

ORGANIC POLYMERS HAVING A MODIFIED SURFACE AND PROCESS THEREFOR

CROSS-REFERENCE TO RELATED APPLICATION

This application is a continuation of application Ser. No. 07/532/048 filed May 25, 1990, abandoned, which is a continuation-in-part of application Ser. No. 344,724 filed Apr. 28, 1989.

FIELD AND BACKGROUND OF INVENTION

The present invention relates to the modification of organic polymer surfaces and the articles produced therefrom. Particularly, the invention relates to organic polymers having a surface modified to improve the adhesive characteristics of such polymers.

It is well known in the art to surface treat organic polymers such as polyesters to improve the utility of such polymers. For example, it is known to treat polyester fibers to improve the adhesion of the polyester to substances such as rubber in the manufacture of tires. In U.S. Pat. No. 4,054,634, multifilament polyethylene terephthalate yarn is treated with a two-part finish, one part of which is applied after spinning and one part of which is applied after drawing. The first part contains a defined polyoxyethylated-polyoxypropylated monoether whereas the second part contains the monoether in combination with a defined epoxy ether silane and a sufficient amount of a water soluble alkaline catalyst to raise the pH to 8–10. Also see U.S. Pat. No. 4,348,517 wherein the same epoxy ether silane is combined with the triglycidyl ether of a glycerol and a defined diglycidyl ether and is used as a fiber finish for polyester yarn.

U.S. Pat. No. 3,793,425 also describes a process for improving the adhesion of polyester material to rubber. In the process, undrawn polyester yarn is coated with a composition containing an epoxy resin which is preferably buffered with an alkaline agent, such as sodium carbonate, lithium carbonate, potassium carbonate or ammonium hydroxide. The use of epoxy resins with alkaline catalysts to improve the adhesion of polyester to rubber is further disclosed in U.S. Pat. Nos. 3,423,230 and 3,464,878.

A process for treating chemically stabilized polyester material to improve the adhesion of the polyester to rubber is also described in U.S. Pat. No. 4,751,143. As noted therein, the aging period for chemically stabilized, adhesive activated polyester material can be reduced by contacting the material before it is substantially drawn or stretched with a composition containing a defined epoxide compound catalyzed with ions of at least one of potassium, cesium, or rubidium at a pH of between about 7.5 to about 13.0.

The application of finishes to the polymer surface generally produces a temporary surface condition such as lubrication or electrostatic charge dissipation which may be removed when the surface is subsequently exposed to multiple processing steps. Additionally, polyester surface modifications of the prior art employing epoxies to improve the adhesion of polyester to rubber for example, have resulted in the creation of toxic working conditions in the manufacture of such surface-modified polyester or in the production of articles which in subsequent processing or use would expose individuals to toxic conditions.

Other approaches employed in art to adjust the characteristics or properties of organic polymer surfaces include electrolytic and plasma treatments. However, these processes are costly and have limited processing rates. The application of a strong acid or base has not been particularly effective in modifying surfaces and can penetrate beyond the surface, particularly in fiber structures, to cause strength loss.

Polyisocyanates have been employed to enhance adhesion in the manufacture of polyester yarns (see U.S. Pat. No. 3,549,740). These materials have been applied at relatively high concentration levels (greater than 0.5 weight percent) and so generate obnoxious vapors, produce deposits on process rolls and bond filaments to filaments in the yarn bundle. Similar processing problems are encountered in the application of known polyester adhesives such as those based upon resorcinol-formaldehyde resins described in U.S. Pat. No. 3,660,202 and U.S. Pat. No. 3,318,750.

Accordingly, it would be desirable to have the capability to permanently modify the organic polymer surface employing a non-toxic process and improve the processing of the organic polymer in the production of articles of manufacture.

SUMMARY OF THE INVENTION

By the invention an organic polymer having a modified surface is obtained, the surface modification is a result of the reaction between a halohydroxy organic compound and a coreactant comprising a cationic compound of an acid having a $pK_a > 2.5$, preferably reacted at an elevated temperature. As applied to polyester, polyetherimide, aromatic polyamide and graphitic polymers, the surface modification improves adhesion of such polymers to rubber and other materials.

DETAILED DESCRIPTION OF THE INVENTION

The invention is useful in conjunction with organic polymers generally but has particular application to polyesters, aromatic polyamides, polyetherimide and graphitic polymers to improve the adhesive characteristics of such polymers. Other suitable organic polymers include nylons, polyketones, polyetherketones, polyethylenes, polyphenylene sulfides and polyvinyl alcohols.

The polyester employed in the present invention can be any polymeric linear ester which may be obtained by reacting one or more glycols of the series $HO(CH_2)_nOH$ wherein n ranges from 2 to 6 with one or more dicarboxylic acids such as naphthalene dicarboxylic acid, 4,4'-diphenyl dicarboxylic acid or, preferably, terephthalic acid. The polyester also may be prepared by alternate techniques such as polymerization of the monoester. The polyester can be a wholly aromatic polyester known to the art such as various combinations of p-hydroxybenzoic acid, 2,6-hydroxynaphthoic acid, 2,5-hydroxynahpthoic acid, 2,6-dihydroxynaphthalene, 2,6-naphthalenedicarboxylic acid, biphenol, bisphenol A, terephthalic acid, isophthalic acid and hydroquinone. Reference is made to U.S. Pat. No. 4,161,470, incorporated by reference, for a further description of such aromatic polyesters.

Additionally, the polyester may be reacted or blended with compatible compounds of polymers which do not substantially adversely affect the characteristics of the polyester. For example, compounds yielding non-ester linkages can be added into the reaction mixture for the polyester or formed polymers, pigments, fillers, antioxidants, etc. can be blended with the polyester. Preferably, polyester is polyethylene terephthalate which has an intrinsic viscosity (IV) of at least 0.35 and when employed in the production of tire yarn or other industrial elastomeric applications has a preferred IV of at least 0.7 deciliters per gram. IV is the intercept at zero concentration of the plot in RV/C vs C at 25° C. of polyester solutions in orthochlorophenol. RV is the relative viscosity and C is the concentration in grams per deciliter.

The graphitic polymers of this invention can be obtained by the carbonization/graphitization of pitch, rayon or acrylonitrile polymers such as described in U.S. Pat. No. 3,775,520 and U.S. Pat. No. 3,954,950, incorporated herein by reference thereto or by other methods known to the art. As described in the references the acrylonitrile polymer is preheated, passed through a preoxidation heating zone having an oxygen atmosphere and then passed through a carbonization/graphitization heating zone provided with an inert atmosphere. The invention is also applicable to polyimides and aromatic polyamides such as poly-paraphenylene terephthalamide, poly-paraphenylene/3,4'-diphenylether terephthalamide and poly-metaphenylene isophthalamide.

The material into which the organic polymer is formed can be of any size and configuration amenable to surface modification processing. The material can therefore be in the form of film, sheets, rods, filaments and the like. As applied to filaments for example, the material can be in the form of monofilament, multifilament yarns, cords and fabrics. As applied to filaments, the invention is particularly applicable to those filaments which have been melt spun and quenched.

The halohydroxy organic compounds of this invention are those wherein the halogen and hydroxy functionalities are reactive and preferably where such halogen and hydroxy functionalities are primary. The term "primary" means that the functionality is attached to a terminal carbon. The functionalities may be in the same or different molecules. Preferably the halogen is selected from the group consisting of chlorine, bromine and iodine and the halohydroxy compound is substantially free of halohydrin and epoxy groups. As applied to the modification of the organic polymer surface for purposes of improved adhesion, the preferred halohydroxy organic compound has at least one chlorine in a—$CH_2$ Cl group and two hydroxyls in the same or different molecules. Preferred examples include chlorinated ethers and thioethers in general and in particular polyoxy-w-haloalkylenes, such as thiochloropropylenes, oxychlorobutylenes, oxy-w-chloroalkylenes, oxychloropropylenes, oxychloropropyl compounds, oxychloroalkyl compounds, oxychloropropylene polycarboxylic esters, thiochloropropylenes. The most preferred group is polyoxychloropropylenes and these compounds can have various terminal groups including hydroxyl (but not chlorohydrin), carboxylic acid ester, ether, 1-thio-2,3-dihydroxypropyl thioether, 1-diglycerol ether, 1,2 dihydroxy 3-thio propyl 1-ether, 1-glycerol ether, 1-ethylene glycol ether, 1-glycerol ethers with a substituent at the 3-position as for example 1,3 glycerol ethers in general or, 1,3 glycerol ethers in which the 3-substituent terminates in one or more primary hydroxyl groups, as for example a 1-ethylene glycol ether or a polyethylene glycol ether, 3-amino-2-hydroxy propyl 1-ether wherein the amino group is tertiary and preferably terminates in one or more primary hydroxyl groups. Polyoxychloropropylenes can be copolyethers with such units as oxyhydroxypropylene, 1,3 glycerol ether, oxyethylene, oxypropylene, oxyalkylene units containing carbon-carbon double bonds, with terminal groups as indicated above, and combinations of different oxychloropropylene polyethers or copolyethers. Other useful compounds include partially chlorine capped ethoxylates, and terminal chloro-alkyl compounds which also contain hydroxyl groups. Also useful are combinations of halogen compounds like polyoxylchloropropylenes with polyhydroxy compounds wherein the polyhydroxy compound has at least one primary hydroxyl group. Such polyhydroxy compounds could be, for example, glycerol, triglycerol, hexaglycerol and decaglycerol, sorbitol, mannitol, sorbitan, triethylene glycol, pentaerythritol, threitol, trimethylol propane, etc. A particularly preferred class of chlorohydroxy organic compounds are those polyoxychloropropylene organic compounds containing at least 10% organic chlorine present in chloro methyl groups and a hydroxyl value of 100–700 mgKOH per gram selected from the group consisting of compounds with oxychloropropylene units on a glycerol backbone with terminal 1-glycerol ethers, such as described in copending application Ser. No. 344,598 filed Apr. 28, 1989 by Norman S. Anderson, Albert L. Promislow, Randy L. Rayborn, and Rastko Vukov entitled: "Novel Polyether Containing At Least One 2-Halomethyloxyethylene Unit And 2,3-Dihydroxypropyl End Groups" and incorporated by reference thereto, compounds with oxychloropropylene on an ethylene glycol backbone with terminal 1-glycerol ethers, and compounds with oxychloropropylene units on a pentaerythritol backbone with terminal 1-glycerol ethers.

The coreactant can be any cationic compound of an acid having a $pK_a > 2.5$, preferably a $pK_a > 3.5$. Suitable coreactants include alkali metal, quaternary ammonium, quaternary phosphonium, and alkaline earth metal hydroxides, bicarbonates, carbonates, sulfites, oxides and carboxylates like acetates, formates, propionates, caprates, octanoates pelargonates, laurates, stearates, isostearates, oleates, dimerates; also alkoxides, aryloxides, borohydrides, dimethylsulfoxide salts, acetamide salts, hydrocarbon salts, and hydrides. Preferred cationic compounds for improved adhesion are those selected from the group consisting of quaternary ammonium and alkali metal hydroxides, bicarbonates, carbonates, and carboxylates like acetates, stearates, isostearates, laurates, octanoate, and dimerates. These compounds can, optionally, be buffered to an acidic pH below 7 with a volatile acid such as carbonic, acetic or propionic.

The halohydroxy organic compound and the coreactant are applied to the organic polymer surface and preferably heated to an elevated temperature of at least 100° C. whereon the reaction occurs to produce a polyether and an inorganic halide in the polymer surface thereby modifying the polymer surface. The coreactant as applied generally comprises at least 0.002 cation equivalents per 10 grams of halohydroxy organic compound and preferably at least 0.005 cation equivalents. The application can be made as an emulsion or as a solution with the halohydroxy organic compound and the coreactant applied separately or together.

Although not to be limited thereto, the invention will hereafter be described in a preferred embodiment. A polyester such as described in U.S. Pat. No. 4,414,169, incorporated by reference thereto, can be extruded as filaments and the filamentary material passed in the direction of its length through a solidification zone wherein the molten filamentary material uniformly is quenched and is transformed to a solid filamentary material.

In one aspect of the invention the halohydroxy organic compound and the coreactant can be applied as an emulsion or solution to the filamentary material as it exits the solidification zone by known techniques such as via a kiss roll, spray, foam, metered applicator, etc. In addition to the halohydroxy organic compound and the coreactant the emulsion may contain other conventional constituents such as emulsifiers, lubricants, biocides, tints, antifoams, antistatic agents, antioxidants, etc., present in known amounts in the emulsion. The polyester filaments following application will normally contain from 0.01 to 0.40 percent of the halohydroxy organic compound and coreactant reaction product based on the weight of the filamentary material.

After the halohydroxy organic compound and the coreactant are applied, the polyester filamentary material can be drawn or stretched to obtain a desired orientation. A total draw of from about 5.0:1.0 to about 6.5:1.0 in a low birefringence process and from about 1.5:1.0 to about 2.8:1.0 in a high birefringence (i.e., high stress) process is typically conducted in one or more drawing stages using known equipment such as pairs of skewed draw rolls.

The draw temperature is selected to yield the desired result. For example, in a high birefringence, two-stage draw process, the first stage can be conducted at a temperature below the glass transition temperature of the polyester (e.g., room temperature) as set forth in aforementioned U.S. Pat. No. 4,414,169. The second stage can also be conducted at a temperature below the glass transition temperature of the polyester (e.g. at room temperature).

After drawing, the polyester filamentary material can be subjected to a relaxing step of from about 0 to about 4% and/or heat setting at from about 190° to about 240° C.

In a second aspect of the invention the halohydroxy organic compound and the coreactant can be applied as an emulsion or solution to the filamentary material after the drawing process employing yarn heating and the known techniques described above. Following application after drawing, the filaments will normally contain from 0.02 to 0.5 percent by weight of the halohydroxy organic compound and coreactant reaction product based on the weight of the filamentary material.

The surface-modified polyester produced by the process described above can be further processed to produce a material having utility in the production of tires and other articles of manufacture. Typically, in the production of such articles, a phenolic-aldehyde-latex composition is applied to the polyester yarn. The phenolic-aldehyde component (e.g. a resole) can be any condensation product of an aldehyde with a phenol which can be heat cured to form an infusible material. A typical phenolic-aldehyde-latex composition is a formulation containing resorcinol-formaldehyde resin and a rubber latex such as styrene-butadiene vinyl pyridine latex (e.g., an RFL composition). The preparation of such compositions is well known in the art.

The phenolic-aldehyde latex composition is generally applied in a quantity of from about 2 to about 10 weight percent (solids retention), based on the weight of the polyester material. Although not to be limited thereto, the phenolic-aldehyde-latex composition is preferably applied after the filament or yarn has been twisted into cord or woven into fabric. Preferably, the composition-coated material is subjected to a drying and curing treatment, both to eliminate the moisture in the coating and to complete the condensation of the phenolic-aldehyde component. The drying and curing operation is conveniently conducted in the presence of hot circulating air at a temperature of from about 120° to about 260° C.

It is within the scope of this invention to apply the halohydroxy organic compound and the cationic compound to the polyester simultaneously with the RFL. Under such circumstances, the halohydroxy organic compound and the cationic compound can be placed in the RFL dip and the polyester immersed in the dip. Alternatively, the halohydroxy organic compound and the cationic compound can be admixed with other agents to achieve desirable results. For example, they can be used to replace the glycerol epoxide in a suspension of phenol blocked methylene-bis(4-phenylisocyanate) and applied to the polyester in cord form in the first step of a two stage process as described in U.S. Pat. No. 3,307,966. The RFL would be applied separately in a second stage.

The surface-modified polyester material onto which the RFL composition has been applied may then be used as reinforcing materials in the preparation of reinforced rubber-based materials such as pneumatic tires, conveyor belts, hoses, transmission belts, raincoats, and the like employing methods known to the art.

The following Examples are given as illustrations of the invention. It should be understood however, that the invention is not limited to the specific details set forth in the Examples.

EXAMPLE 1

Molten polyethylene terephthalate (PET) having an intrinsic viscosity of 0.90 deciliters/gram was spun at a temperature of 304° C. The product spun filaments were subjected to a two-stage drawing process with the first stage being conducted at 115° C. temperature and at a draw ratio of 3.48:1 and with the second stage being conducted at 125° C. temperature and at a draw ratio of 1.65:1. The PET yarn was heat set at about 240° C. and then wound at a speed of 6860 fpm to obtain a slight relaxation. The yarn was of 1000 denier.

In this Example a blend was prepared containing 13.0 weight percent of a glycerol ether containing nominally four oxychloropropylene units with terminal 1-glycerol ether units, 1.6 weight percent potassium carbonate and 85.4 weight percent of a mixture comprising organomodified silicone, ethoxylated sorbitan mono-oleate, and ethoxylated octylphenol. Analysis of the glycerol ether showed it to have a hydroxyl value of 501 mgKOH/g, an organic chlorine content of 18.5%, an epoxy value of 0.03% (as epichlorohydrin) and a chlorohydrin value which was not detectable. The blend comprising 15 weight percent of an aqueous emulsion was applied as a spin finish using kiss rolls as the filaments exited the solidification zone and prior to drawing. The dry weight concentration of finish measured on the yarn after wind-up as determined by extraction with methanol was 0.59% which is representative of a reaction product concentration of 0.086 weight percent.

After drawing, the filaments were twisted into cord by twisting the 1000 denier filaments in the S direction to obtain 12 turns per inch and then plying the ends together and twisting in the Z direction to obtain 12 turns per inch (1000/2 12×12 tpi). The cord was then treated using a dip pick-up of 7.0% solids with a resorcinol-formaldehyde-latex (RFL) composition having the following ingredients:

| Ingredients | Parts By Wet Weight |
|---|---|
| Water | 363.4 |
| Resorcinol | 16.6 |
| Sodium hydroxide (50% aqueous) | 2.6 |
| Formaldehyde (37% aqueous) | 14.7 |
| Terpolymer latex of styrene/1,3-butadiene/2-vinyl pyridine 15/70/15 (41% active) | 215 |
| Styrene/butadiene latex (41% active) | 55.4 |

The composition was prepared by adding 16.6 parts of the resorcinol to 363.4 parts of water followed by the addition of 14.7 parts of formaldehyde (37%) and 2.6 parts of 50% NaOH. The resulting mixture was aged for 1¾ hrs. and then 215 parts of the terpolymer rubber latex and 55.4 parts of styrene/butadiene latex were added. The resulting mixture was then aged for a period of 24 hours.

After coating with the RFL, the coated cord was subjected to a conventional curing using a Litzler Computreator at standard conditions for tire cord. The treated cord was placed on a fabric backed rubber piece by winding on a rotating drum. The cord was placed with as tight as possible an end count. The fabric was cut into two 3"×3" squares and these squares were placed together, treated cord to treated cord, with a rubber layer 0.040" thick in between. The sample was then vulcanized at 320° F. for 20 minutes at 50 psi and the vulcanized sample was cut into three 1" strips.

1" strips were placed in an environmental chamber at 250° F. for 15 minutes and then the fabric plies were pulled apart at 250° F. on an Instron tensile tester. To test adhesion under more severe conditions, further 1" strips were placed in an autoclave and subjected to 12 psi steam for two hours, allowed to cool, and the fabric plies were pulled apart at ambient conditions.

Adhesion is set forth in following Table I (250° F. Peel Test and Two Hour Steam Peel Test) as pounds/inch and visual rating. Pounds/inch is the average force required to pull the strip apart and the visual rating is on a 1 to 5 scale where 1.0 is total failure at the cord surface and 5.0 is cohesive failure in the rubber compound.

For purposes of comparison, a yarn produced as described above with the exception that a standard non-adhesive activating finish at a concentration level of 0.6% was applied in place of the finish containing the glycerol ether and potassium carbonate. The yarn was tested for adhesion and results (Control) are shown in Table 1.

EXAMPLE 2

Example 1 was repeated with the exception that the halohydroxy compound used was a glycerol ether containing nominally two oxychloropropylene units, with terminal 1-glycerol ether units. This compound had a hydroxyl value of 574 mg KOH/g, an organic chlorine content of 13.7%, an epoxy value of 0.04% and a chlorohydrin content of 0.42%.

The halohydroxy compound was used with potassium carbonate as a coreactant in a spin finish comprising on a dry weight basis: 13% halohydroxy compound, 1.6% potassium carbonate, and 85.4% of the same lubricating, emulsifying blend as employed in Example 1. This was applied to the yarn after solidification and prior to drawing from a 15% aqueous emulsion. The measured dry level of finish on yarn after wind-up was 0.53% weight percent which is representative of a reaction product concentration of 0.077 weight percent.

Thereafter, the evaluation was carried out as in Example 1 and the adhesion results are shown in Table 1.

EXAMPLE 3

Example 1 was repeated with the exception that the halohydroxy surface-modifying compound was an ethylene glycol ether containing nominally two oxychloropropylene units, terminated by 1-glycerol ethers. The chemical was analyzed as having a hydroxyl value of 533 mg KOH/g, an organic chlorine content of 18.3%, an epoxy value of 0.24% and a chlorohydrin value of 0.23%.

This halohydroxy compound was used with potassium carbonate as the coreactant in a spin finish, comprising on a dry weight basis: 17.5% halohydroxy compound, 2.0% potassium carbonate, and 80.5% of the same lubricating, emulsifying blend as used in Example 1. This finish was applied to the yarn after solidification but prior to drawing from a 15% solids aqueous emulsion. The measured dry level of finish on yarn after windup was 0.47% weight percent which represents a reaction product concentration of 0.092 weight percent.

Thereafter, the evaluation was carried out as in Example 1 and the adhesion results are shown in Table 1.

EXAMPLE 4

Example 1 was repeated with the following exceptions:

The halohydroxy compound employed was a polyether with nominally two oxychloropropylene units and four 1,3-glycerol ether units and terminal 1-glycerol ether units. This compound was analyzed as having a hydroxyl value of 670 mgKOH/g, an organic chlorine content of 10.5% and an epoxy value that was less than 0.05%. This halohydroxy compound was made by reacting a glycerol polyglycidyl ether of chlorine content 10.7% and epoxy value 6663 microequivalents per gram with water in presence of an acid catalyst until no epoxy groups could be detected.

The lubricating/emulsifying part of the composition applied as a spin finish comprised a pentaerythritol tetrapelargonate, a sorbitol ester ethoxylate, a castor oil ethoxylate, a decaglycerol hexaoleate and an antioxident. The dry proportions of ingredients in the finish were: 15% halohydroxy compound, 0.97% potassium carbonate and 84.03% of the above blend of emulsifiers and lubricants.

The finish was metered as a 15% solids aqueous emulsion on to the yarn prior to drawing. The measured finish on the yarn after drawing was 0.55% weight percent which represents a reaction product concentration of 0.088 weight percent.

The yarn was further finished after drawing with 0.4% on yarn of a mixture of n-butyl stearate and a lauric acid etholxylate. After twisting to 1000×2, 12×12 turns per inch, the resultant cord was coated with 5% of the following RFL dip on a dry weight basis, passed through a Litzler computreator with zone 1 operated at 250° F., for 110 seconds with a 1% stretch, then passed through zone 2 at 440° F. for 50 seconds with a 0.5% relax. The RFL composition was as follows:

| Ingredients | Parts by Wet Weight |
|---|---|
| Water | 331 |
| NaOH (50% aqueous soln) | 2.6 |
| Resorcinol | 16.6 |
| Formaldehyde (37% aq. soln) | 17.2 |
| Terpolymer rubber latex of Styrene/1,3 butadiene/2-vinyl pyridine 15/70/15 (41% latex) | 245 |

The above composition was prepared by adding the 16.6 parts of resorcinol into the 331 parts of water, followed by the addition of 17.2 parts of formaldehyde (37%) and 2.6 parts of 50% NaOH aqueous solution. This mixture is aged for one hour and then 245 parts of the terpolymer latex were stirred in. The resulting mixture was then aged for 72 hours.

The treated cord was then bonded to rubber as in Example 1, and the steam adhesion results are shown in Table I.

EXAMPLE 5

Example 4 was repeated with the exception that the dip also contained 1.0 weight percent of phenol blocked methylene bisphenyl isocyanate. Results are shown in Table I.

EXAMPLE 6

Example 1 was repeated except as hereafter described.

The blend applied as a spin finish had the following composition on a dry weight basis:

| | |
|---|---|
| Halohydroxy compound of Example 1 | 20.00% |
| Rubidium carbonate | 3.84% |
| Lubricants/emulsifiers of Example 1 | 76.16% |

The finish was metered on to the yarn from a 15.0 weight percent solids aqueous emulsion prior to drawing. After drawing the concentration of the methanol extracted finish on the yarn was measured as 0.43 weight percent which represents a reaction product concentration of 0.103 weight percent.

Further processing and testing was conducted as described in Example 1 and the adhesion results are shown in Table I.

EXAMPLE 7

Example 1 was repeated with the following exceptions:

The blend applied as a spin finish had the following composition on a dry weight basis:

| | |
|---|---|
| Halohydroxy compound of Example 1 | 13.00% |
| Rubidium carbonate | 3.01% |
| Carbon dioxide | 0.57% |
| Lubricants/emulsifiers of Example 1 | 83.42% |

The halohydroxy compound and the lubricants/emulsifiers were made into an aqueous emulsion and the rubidium carbonate was mixed with the emulsion. Carbon dioxide was added to reduce the pH to 7.8. The final emulsion comprising 15.0 weight percent solids was metered on to the yarn prior to drawing. After drawing, the concentration of the finish on the yarn was 0.58 weight percent as measured by methanol extraction which represents a reaction product concentration of 0.096 weight percent.

Further processing and testing was conducted as in Example 1 and the adhesion results are shown in Table I.

EXAMPLE 8

Example 1 was repeated with the following exceptions:

The blend applied as a spin finish had the following composition on a dry weight basis:

| | |
|---|---|
| Halohydroxy compound of Example 1 | 20.00% |
| Tetraethyl ammonium hydroxide | 2.77% |
| Carbon dioxide | 0.41% |
| Lubricants/emulsifiers of Example 1 | 76.82% |

As in Example 7, the halohydroxy compound and the lubricant/emulsifiers were formed into an aqueous emulsion and the tetraethyl ammonium hydroxide mixed with the emulsion. Sufficient carbon dioxide was added to reduce the pH to 9.6, forming the carbonated quaternary ammonium cation. The final emulsion comprising 15.0 weight percent solids was metered to the yarn prior to drawing. After drawing, concentration of the methanol extracted finish on the yarn was 0.49 weight percent which represents a reaction product concentration of 0.114 weight percent.

Further processing and testing was conducted as in Example 1 and the adhesion results are shown in Table I.

EXAMPLE 9

Example 4 was repeated with the following exceptions:

The spin finish applied had the following composition on a dry weight basis:

| | |
|---|---|
| Halohydroxy compound of Example 4 | 15.00% |
| Potassium bicarbonate | 2.32% |
| Lubricants/emulsifiers of Example 1 | 82.68% |

The spin finish blend was metered on to yarn from a 15.0 weight percent solids aqueous emulsion prior to drawing. After drawing, extractable finish on yarn was determined to be 0.59 weight percent, which represents a reaction product concentration on the yarn of 0.102 weight percent. An additional finish comprising 0.4 weight percent n-butyl stearate and ethoxylated lauric acid was applied to the yarn prior to twisting.

Further processing and testing was conducted as in Example 4 and the steam adhesion results are shown in Table 1.

EXAMPLE 10

Example 4 was repeated with the following exceptions:

The spin finish applied to the yarn had the following composition on a dry weight basis:

| | |
|---|---|
| Halohydroxy compound of Example 4 | 15.00% |
| Potassium hydroxide | 0.65% |
| Lubricants/emulsifiers of Example 1 | 84.35% |

The finish was metered on to the yarn from a 15 weight percent solids aqueous emulsion prior to drawing. After drawing, the amount of extractable finish on the yarn was determined to be 0.61 weight percent, which represents a concentration of reaction product on the yarn of 0,095 weight percent. An additional finish of 0.4 weight percent n-butyl stearate and ethoxylated lauric acid was applied to the yarn prior to twisting.

After twisting to obtain a 1000/2 12×12 tpi cord, the cord was evaluated for adhesion in the same manner as in Example 4. Steam adhesion results are shown in Table I.

EXAMPLE 11

Example 4 was repeated with the following exceptions:

The spin finish applied to the yarn had the following composition on a dry weight basis:

| | |
|---|---|
| Halohydroxy compound of Example 4 | 15.00% |
| Cesium carbonate | 3.77% |
| Lubricants/emulsifiers of Example 1 | 81.23% |

The finish was metered on to the yarn prior to drawing from a 15 weight percent solids aqueous emulsion. After drawing, the amount of extractable finish on the yarn was determined to be 0.48 weight percent which represents a concentration of reaction product on the yarn of 0.090 weight percent. An additional finish of 0.4 weight percent n-butyl stearate and ethoxylated lauric acid was applied to the yarn prior to twisting.

After twisting to 1000/2 12×12 tpi cord, the cord was evaluated for adhesion in the same manner as in Example 4. Steam adhesion results are shown in Table I.

EXAMPLE 12

Example 4 was repeated with the following exceptions:

The spin finish applied to the yarn had the following composition on a dry weight basis:

| | |
|---|---|
| Halohydroxy compound of Example 4 | 15.00% |
| Sodium carbonate | 1.44% |
| Lubricants/emulsifiers of Example 1 | 83.56% |

The finish was metered on to the yarn prior to drawing from a 15 weight percent solids aqueous emulsion. After drawing, the amount of extractable finish on the yarn was determined to be 0.57 weight percent, which represents a reaction product concentration of 0.094 weight percent on the yarn. An additional finish of n-butyl stearate and ethoxylated lauric acid was applied to the yarn at a 0.4 weight percent level prior to twisting.

After twisting to 1000/2 12×12 tpi cord, the cord was evaluated for adhesion in the same way as in Example 4. Steam adhesion results are shown in Table I.

TABLE I

| | 250° F. Peel Test | | Two Hour Steam Peel Test | |
|---|---|---|---|---|
| Example | Pull Force (lbs/inch) | Visual Rating | Pull Force (lbs/inch) | Visual Rating |
| Control | 13.2 | 1.8 | 9.4 | 1.2 |
| 1 | 35.3 | 4.5 | 45.3 | 3.6 |
| 2 | 35.4 | 4.7 | 50.7 | 3.7 |
| 3 | 34.4 | 4.5 | 42.3 | 3.2 |
| 4 | | | 25.0 | 2.1 |
| 5 | | | 65.0 | 4.9 |
| 6 | 35.5 | 4.0 | 53.4 | 3.7 |
| 7 | 40.0 | 3.8 | 37.7 | 2.9 |

TABLE I-continued

| | 250° F. Peel Test | | Two Hour Steam Peel Test | |
|---|---|---|---|---|
| Example | Pull Force (lbs/inch) | Visual Rating | Pull Force (lbs/inch) | Visual Rating |
| 8 | 33.8 | 3.5 | 34.5 | 2.5 |
| 9 | | | 32.5 | 2.7 |
| 10 | | | 24.0 | 2.2 |
| 11 | | | 44.0 | 3.0 |
| 12 | | | 28.5 | 2.2 |

From the data presented in Table I the effectiveness of the invention to substantially improve adhesion of polyester to elastomeric materials is demonstrated for a variety of halohydroxy compounds and coreactants and under different processing conditions.

EXAMPLE 13

A commercial 0.90 iv polyethylene terephthalate industrial yarn was twisted into a 1000/2 12×12 tpi cord, and the cord adhesively treated on a laboratory Litzler Computreator using a two-stage process. In the first stage, the cord was stretched 3% and exposed for 30 seconds at 400° F.; in the second stage, the cord was relaxed 2% and RFL adhesive having the composition of Example 4 was applied to the yarn to achieve a 3 weight percent solids pickup, and then the cord was exposed to 450° F. temperature for 50 seconds.

The treated cord was then subjected to adhesive testing by the method described in Example 1 and the results are shown in Table II.

EXAMPLE 14

Example 13 was repeated with the exception that after tensioning in the first stage, the cord was passed through an aqueous solution containing one part of the halohydroxy compound of Example 2, 0.8 part potassium bicarbonate and 100 parts water. The excess solution was blown off to achieve an application level of 0.2 dry weight percent on cord.

The treated cord was then subjected to adhesion testing and the results are shown in Table II demonstrating that substantially better adhesion was achieved than in Example 13 where application of the halohydroxy compound and coreactant were omitted.

EXAMPLE 15

Example 14 was repeated with the exception that the aqueous adhesive solution consisted of one part of the halohydroxy compound of Example 1, 0.8 part of potassium bicarbonate, 75 parts water and 50 parts acetone for purposes of solubilizing the mixture. Adhesion data is shown in Table II.

EXAMPLE 16

Example 14 was repeated with the exception that potassium bicarbonate was omitted from the aqueous solution. The adhesion results are shown in Table II demonstrating the necessity of utilizing a coreactant to achieve the improved adhesion when compared with the results obtained in Example 14.

EXAMPLE 17

Example 15 was repeated with the exception that the halohydroxy compound in the solution was replaced with a glycerol ether with nominally four oxychloropropylene groups and terminal groups of 3-(polyoxyethylene(3.5))-glycerol 1-ether which was analyzed as having an hydroxyl value of 278 mg KOH/g, and an organic chlorine content of 12.1%, an epoxy value of 0.36% and a chlorohydrin content of 0.23%. The adhesion data are shown in Table II.

EXAMPLE 18

Example 15 was repeated with the exception that the halohydroxy compound in the solution was glycerol ether with nominally four oxychloropropylene groups and terminal groups of 3-(diethanolamino)-2-hydroxy propyl 1-ether. This material had a hydroxyl value of 303 mgKOH/g, an organic chlorine content of 14.2% and undetectable levels of chlorohydrin and epoxy. The adhesion results are shown in Table II.

TABLE II

| | 250° F. Peel Test | | Two Hour Steam Peel Test | |
|---|---|---|---|---|
| Example | Pull Force (lbs/inch) | Visual Rating | Pull Force (lbs/inch) | Visual Rating |
| 13 (Control) | 12 | 1.1 | 6 | 1.0 |
| 14 | 25 | 3.0 | 37 | 3.0 |
| 15 | 23 | 2.5 | 35 | 2.8 |
| 16 | 9 | 1.1 | 11 | 1.0 |
| 17 | 21 | 2.4 | 20 | 1.6 |
| 18 | 16 | 1.7 | 16 | 1.4 |

From the above, it is apparent that substantial improvement in adhesion is obtained by reacting a halohydroxy compound and the coreactant on the polymer surface.

EXAMPLES 19-22

Example 14 was repeated with the exception that the aqueous solution consisted of 1.2 parts of the halohydroxy compound of Example 2 and 0.8 part of potassium bicarbonate (Example 19), or 0.55 parts of potassium carbonate (Example 20), and the heat treatment in stage 1 was adjusted to 350° F. for 30 seconds dwell. Additionally, the pH of the aqueous solution of Example 20 is reduced by the addition of acetic acid to 7.0 (Example 21) and to 5.0 (Example 22). A control was prepared without the addition of the aqueous solution. The strength of treated cord increased as the pH was reduced.

The treated cords were then subjected to adhesion testing as described in Example 1 and the results are shown in TABLE III.

TABLE III

| | 250° F. Peel Test | | Two Hour Steam Peel Test | |
|---|---|---|---|---|
| Example | Pull Force (lbs/inch) | Visual Rating | Pull Force (lbs/inch) | Visual Rating |
| Control | 25 | 1.5 | 8 | 1.0 |
| 19 | 75 | 4.9 | 36 | 2.8 |
| 20 | 72 | 4.9 | 42 | 2.8 |

EXAMPLE 23

Celion[1], size free and 6 Kfil count, was twisted to form a 3600 denier/1, 3 tpi yarn and then adhesive treated in accordance with the procedure of Example 13 with the following differences. In zones 1 and 2, the cord was tensioned to 400 g and exposed to a temperature of 450° F. for 40 seconds, and a different RFL formulation, described below, was applied in Zone 2.

[1]A trademark of BASF Structural Materials, Inc.

The first part of the adhesive was prepared by mixing 26.0 parts water, 2.1 parts ammonium hydroxide (28.0 weight percent) and 7.8 parts resorcinol formaldehyde resin (70 weight percent). A second part of the formulation was prepared by mixing 14.0 parts water and 4.2 parts formalin (37.0 weight percent). The final formulation comprised 57.6 parts water, 90.0 parts of the terpolymer latex of Example 1, and parts 1 and 2 with part 1 being aged 1.5 hours before mixing with part 2 and the terpolymer latex.

Treated carbon cord was then subjected to adhesive testing by the method described in Example 1 and the results are shown in Table IV.

EXAMPLE 24

Example 23 was repeated with the exception that after tensioning in the first stage, the carbon cord was passed through an aqueous solution containing one part of the halohydroxy compound of Example 2, 0.8 part potassium bicarbonate and 100 parts water. The excess solution was blown off to achieve an application level of 0.2 weight percent on cord.

The treated cord was then subjected to adhesive testing. The results are shown in Table IV.

TABLE IV

| | 250° F. Peel Test | | Two Hour Steam Peel Test | |
|---|---|---|---|---|
| Example | Pull Force (lbs/inch) | Visual Rating | Pull Force (lbs/inch) | Visual Rating |
| 23 (Control) | 52 | 3.4 | 40 | 2.6 |
| 24 | 64 | 4.9 | 57 | 3.6 |

From the above, it is apparent that improved adhesiveness of the graphitic polymer to elastomeric compositions is obtained by employing the halohydroxy and cationic compounds of the invention. Additionally, the carbon cords of Example 24 were cleaner.

EXAMPLE 25

Kevlar[2] aramid yarn of 1500 denier was converted to a 1500/2, 9×9 tpi twisted cord and then adhesive treated in accordance with the procedure described in Example 13 with the following exceptions. In zone 1, the cord was tensioned to 1000 g and exposed to a temperature of 450° F. for 50 seconds, while in zone 2, the tension was adjusted to 400 g and the RFL formulation (Example 23) was applied and then cured for 50 seconds at 450° F.

[2]A trademark of DuPont

The treated Kevlar cord was then subjected to adhesive testing by the method described in Example 1 and the results are shown in Table V.

EXAMPLE 26

Example 25 was repeated with the exception that after tensioning in the first stage, the Kevlar cord was passed through a solution consisting of 100 parts water, 50 parts acetone, 1.2 parts of an ether of glycerol with nominally 6 oxychloropropylene units, with terminal 1-glycerol ethers, and 0.80 part potassium bicarbonate before the heat treatment. The halohydroxy compound had a hydroxyl value of 347 mgKOH/g, an organic chlorine content of 23.5%, an epoxy value of 0.17% and a chlorohydrin value of 0.49%.

The treated Kevlar cord was then subjected to adhesive testing. The results are shown in Table V demonstrating improved adhesiveness of the aromatic polyamide to elastomers with application of the halohydroxy compound and coreactant.

TABLE V

| Example | 250° F. Peel Test Pull Force (lbs/inch) | 250° F. Peel Test Visual Rating | Two Hour Steam Peel Test Pull Force (lbs/inch) | Two Hour Steam Peel Test Visual Rating |
|---|---|---|---|---|
| 25 (Control) | 44 | 3.5 | 22 | 1.6 |
| 26 | 60 | 4.8 | 33 | 2.0 |

EXAMPLE 27

Example 13 was repeated with the exception that in the first stage the polyethylene terephthalate cord was tensioned to 1000 g and treated at 350° F. for 50 seconds and the RFL formulation had the following composition:

| Ingredients | Parts by Net Weight |
|---|---|
| Sodium hydroxide (50.0 weight percent) | 2.6 |
| Resorcinol | 16.6 |
| Formalin (37.0 weight percent) | 14.7 |
| Terpolymer latex of styrene/1,3-butadyne-2-vinyl pyridine (15/70/15-41% active) | 245 |
| Water | 331 |
| Phenyl blocked bis methylene diphenylisocyanate | 61 |

The treated polyethylene terephthalate cord was then subjected to steam adhesive testing by the method described in Example 1 and the results are shown in Table VI.

EXAMPLE 28

Example 27 was repeated with the exception that after tensioning in the first stage, polyethylene terephthalate cord was passed through an aqueous solution consisting of 100 parts water, 2.4 parts of an ethanol ether nominally having two oxychloropropylene units and a terminal 1-glycerol ether, 0.55 part potassium carbonate and 0.20 part of aerosol OT (75 weight % solid) which is a sulfosuccinate wetting agent. The halohydroxy compound had a hydroxyl value of 282 mgKOH/g, an organic chlorine content of 23.8%, an epoxy value of 0.20% and a chlorohydrin value of 0.4%.

The treated cord was then subjected to steam adhesive testing and the results are shown in Table VI demonstrating the effectiveness of the invention to improve adhesion.

TABLE VI

| Example | Two Hour Steam Peel Test Pull Force (lbs/inch) | Two Hour Steam Peel Test Visual Rating |
|---|---|---|
| 27 (Control) | 19 | 1.5 |
| 28 | 60 | 3.8 |

EXAMPLE 29

Example 13 was repeated with the exception that after tensioning in the first stage, the cord was passed through a solution in zone 1 containing 1.2 parts of a glycerol ether and 0.8 part of potassium bicarbonate in 20 parts of water and 80 parts of methanol. The glycerol ether was prepared by the combination of two etherified glycerol molecules wherein one 2,3 dihydroxypropyl end group from one molecule reacts with the epoxide of another molecule during the hydrolysis reaction to join the molecules through an ether linkage, and the resulting dimer contains on average approximately two and one-half 2-bromomethyloxyethylene units and approximately one 2-hydroxymethloxyethylene unit together with uncombined 2,3-dihydroxypropyl end groups. The bromohydroxy compound had a hydroxyl value of 452 mgKOH/g, an organic bromine content of 23.1%, a low epoxy value of 0.02% and a bromohydrin content of 1.7%, and a weight average molecular weight of 834, as measured by gel permeation chromatography.

The treated cord was then subjected to adhesion testing by the method described in Example 1 and the results are shown in Table VII demonstrating that marked adhesion improvement is achieved when compared to the Example 13 control when the halohydroxy organic compound is bromo substituted.

TABLE VII

| Example | 250° F. Peel Test Pull Force (lbs/inch) | 250° F. Peel Test Visual Rating | Two Hour Steam Peel Test Pull Force (lbs/inch) | Two Hour Steam Peel Test Visual Rating |
|---|---|---|---|---|
| 13 (Control) | 12 | 1.1 | 6 | 1.0 |
| 29 | 36 | 3.8 | 27 | 2.1 |

EXAMPLE 30

Example 14 was repeated with the exception that the aqueous solution contained 0.55 part triglycerol (trimerized glycerol commercially produced by Mazer Chemical Company), 0.55 part of a glycerol ether with nominally 1 oxychloropropylene group and terminal 1,3 glycerol ethers in which the 3-substituent is a 2-hydroxy propyl ether, 0.8 part potassium bicarbonate and 100 parts water. The halohydroxy compound had a hydroxyl value of 557 mg KOH/g, an organic chlorine content of 7.1% and an epoxy value of less than 0.1%.

The treated cord was then subjected to adhesion testing in accordance with the procedure of Example 1 with the exceptiont that the peel test was conducted at 75° F. and the results are shown below in Table VIII.

EXAMPLE 31

Example 13 was repeated with the exception that after tensioning in the first stage the cord was passed through an aqueous suspension consisting of 100 parts water, 2.9 parts phenol blocked methylene bisphenylisocynate, 1.2 parts of the halohydroxy compound of Example 2, 0.80 part of potassium bicarbonate and 0.1 part sodium sulfo succinate wetting agent. The excess solution was blown off to achieve an application level of 0.8 dry weight percent on cord. The first stage temperature was set at 450° F. for 50 seconds and the second stage was set at 420° F. for 50 seconds. The RFL formulation employed in the second stage was that of Example 23.

The treated cord was then subjected to steam adhesive testing by the method described in Example 1 and the results are shown in Table VIII.

TABLE VIII

| Example | 75° F. Peel Test Pull Force (lbs/inch) | 75° F. Peel Test Visual Rating | Two Hour Steam Peel Test Pull Force (lbs/inch) | Two Hour Steam Peel Test Visual Rating |
|---|---|---|---|---|

TABLE VIII-continued

| | | | | |
|---|---|---|---|---|
| 30 | 61 | 3.2 | 19 | 2.0 |
| 31 | | | 56 | 4.7 |

The above data demonstrates the effectiveness of the invention to promote adhesion by employing a mixture of a polyol without a primary chloride and a chloro-containing compound without primary alcohols. Additionally, the utilization of a phenol blocked methylene bisphenylisocynate in combination with a halohydroxy compound and a cationic compound to promote adhesion prior to the application of the RFL formulation is demonstrated.

EXAMPLE 32

The procedure of Example 14 was repeated except that 0.63 parts of calcium acetate was used rather than the potassium bicarbonate. The adhesion result of the steam aged specimen was 25 lbs. force and 2.2 rating vs. 6 lbs. force and 1.0 rating in the control, demonstrating that alkaline earth salts can be effective coreactants.

EXAMPLE 33

A fully aromatic polyester yarn, 916 denier, 180 filaments, was twisted into a 960/2, 10×10 tpi cable cord and the cord adhesive treated on a laboratory Litzler Computreator using a two stage process. In the first stage the cord was passed through a water bath, stretched 0.5% while being exposed to a temperature of 400° F. for 20 seconds. In the second stage the cord was passed through an RFL adhesive as described in Example 23 to achieve a 3.5 weight percent solids pickup, then maintained at constant length while being exposed for 50 seconds at 450° F.

The treated cord was then subjected to adhesive testing by the method described in Example 1 and the results (Example 33*a*) are shown in Table IV.

The above procedure was repeated with the exception that after tensioning in the first stage the cord was passed through an aqueous solution containing one part of the halohydroxy compound of Example 2, 0.78 part of potassium acetate and 100 parts of water. The excess solution was blown off to achieve an application level of 0.2 weight percent adhesive on the cord.

The treated cord was then subjected to adhesive testing by the method described in Example 1 and the results (Example 33*b*) are shown in Table IX.

EXAMPLE 34

A polyetherimide yarn, 920 denier, 100 filaments, and finish free, was twisted into a 920/2, 10×10 tpi cord and the cord treated under the conditions of Example 33 except that the temperature of the second stage was maintained at 420° F. The treated cord was then subjected to adhesive testing by the method described in Example 1 and the results (Example 34*a*) are shown in Table IX.

The above procedure was repeated with the exception that the cord was passed through the aqueous solution of Example 33 and the results (Example 34b) are shown below in Table IX.

TABLE IX

| | 250° F. Peel Test | | 75° F. Peel Test | | Two Hour Steam Peel Test | |
|---|---|---|---|---|---|---|
| Example | Pull Force (lbs/inch) | Visual Rating | Pull Force (lbs/inch) | Visual Rating | Pull Force (lbs/inch) | Visual Rating |
| 33a | 15 | 1.8 | 35 | 2.2 | 14 | 1.3 |
| 33b | 24 | 2.6 | 45 | 3.0 | 24 | 2.0 |
| 34a | 8 | 1.0 | 17 | 1.5 | 9 | 1.0 |
| 34b | 15 | 1.6 | 20 | 2.2 | 8 | 1.0 |

From the above it is apparent that substantial modification of the surfaces of the wholly aromatic polyester (Example 33*b*) and the polyetherimide (Example 34*b*) yarns was achieved by reacting the halohydroxy compound and the coreactant on the polymer surfaces.

EXAMPLE 35

Example 13 was repeated with the exception that in the first stage of the treatment the cord was passed through an aqueous solution containing only one part of the halohydroxy compound of Example 2 in 100 parts of water prior to the heat treatment at that stage, and excess solution was blown off to achieve an application level of 0.2 weight percent. In the second stage, the cord was allowed to relax 3%.

The treated cord was then subjected to adhesion testing and the results are provided in Table X.

EXAMPLE 36

Example 35 was repeated with the exception that 0.55 part of potassium carbonate was added to the aqueous solution of the first stage. The results of the adhesion testing are provided in Table X.

EXAMPLE 37

Example 35 was repeated with the exception that 0.78 part of potassium acetate was added to the aqueous solution of the first treatment stage. The results of the adhesion testing are provided in Table X.

EXAMPLE 38

Example 35 was repeated with the exception that 0.97 part potassium benzoate was added to the aqueous solution of the first treatment stage. The results of the adhesion testing are presented in Table X.

EXAMPLE 39

Example 35 was repeated with the exception that 0.67 part potassium formate was added to the aqueous solution of the first treatment stage. The results of the adhesion testing are shown in Table X.

EXAMPLE 40

Example 35 was repeated with the exception that 0.68 part potassium nitrite was added to the aqueous solution of the first treatment stage. The results of the adhesion testing are presented in Table X.

EXAMPLE 41

Example 35 was repeated with the exception that 1.25 parts of potassium orthochlorobenzoate was added to the aqueous solution of the first treatment stage. The results of the adhesion testing are shown below in Table X.

TABLE X

| Example | pKa | 75° F. Peel Test Pull Force (lbs/inch) | 75° F. Peel Test Visual Rating | Two Hour Steam Peel Test Pull Force (lbs/inch) | Two Hour Steam Peel Test Visual Rating |
|---|---|---|---|---|---|
| 35 | — | 18 | 1.4 | 9 | 1.0 |
| 36 | 10.2 | 56 | 4.4 | 30 | 2.4 |
| 37 | 4.8 | 56 | 4.7 | 33 | 2.6 |
| 38 | 4.2 | 57 | 4.9 | 36 | 2.6 |
| 39 | 3.8 | 45 | 3.8 | 32 | 2.6 |
| 40 | 3.4 | 53 | 4.7 | 28 | 2.2 |
| 41 | 2.9 | 47 | 3.5 | 15 | 1.5 |

From the above presented dates, the effectiveness of the invention to modify the polyethylene terephthalate surface and thus improve the adhesion to elastomeric materials is demonstrated for a variety of coreactants of acids having a range of $pK_a$ values.

EXAMPLE 42

Example 1 was repeated with the exceptions of the spin finish and the RFL dip utilized. The spin finish comprised 10.0 weight percent of a glycerol ether containing nominally four oxychloropropylene units with terminal 1-glycerol ether units, 0.6 weight percent stearic acid, 6.0 weight percent isostearic acid, 1.5 weight percent of potassium hydroxide and 81.9 weight percent of a mixture comprising organo-modified silicone, ethoxylated sorbitan mono-oleate and ethoxylated octylphenol. The potassium hydroxide and the fatty acids react to provide the fatty acid salts.

Analysis of the glycerol ether showed it to have a hydroxyl value of 458 mgKOH/g, an organic chlorine content of 18.7 weight percent, an epoxy value of 0.15% (as epichlorohydrin) and a chlorohydrin value of 0.29% (as chlorine).

The blend comprising 15 weight percent of an aqueous emulsion having a pH at make-up of 10.0 was applied to yarn as a spin finish using a metered application as the filaments exited the solidification zone and prior to drawing. The dry weight of finish on yarn after wind-up as determined by methanol extraction was 0.54 weight percent which is representative of a reaction product concentration at 0.10 weight percent.

After twisting two 1000 denier yarns Z and S and plying them to a 12×12 twist per inch level, the cord was dipped in the RFL emulsion to achieve a 3.5 weight percent dry pickup. The RFL formulation used was that of Example 23 with the addition of 1.5 parts of acrylic thickening resin ASE-95 (20% active) and 0.43 part of sodium hydroxide (50% active) and 4.3 parts of phenol-blocked methylene diphenyl isocyanate (dry material) to the final stage of the preparation.

After coating with the RFL, the coated yarn was subjected to a onventional curing using a Litzler Computreator at standard conditions for tire cord. Peel test strips were prepared as in Example 1. The peel test pieces were pulled apart at room temperature. The peel force measured on two peel strips were 53 and 57 lbs/inch with visual ratings of 3.0 and 3.0 lbs/inch. A lubricated yarn with no halohydroxy adhesive had peel forces of 27 and 31 lbs/inch with visual ratings of 2.0 and 2.0.

EXAMPLE 43

Example 42 was repeated with the exception of the spin finish. The dry spin finish comprised 13.0 weight percent of a glycerol ether containing nominally four oxychloropropylene units with terminal 1-glycerol ether units, 4.7 weight percent potassium hydroxide and 81.0 weight percent of a mixture which is comprised of organo-modified silicone, ethoxylated sorbitan mono-oleate and ethoxylated octylphenol. The polyoxychloropropylene compound used was the same as employed in Example 42.

The blend as a 15 weight percent aqueous emulsion having a pH at make-up of 10.3, was applied to yarn as a spin finish using a metered applicator as the filaments exited the solidification and prior to drawing. The dry weight of finish on yarn after wind-up, as determined by methanol extraction, was 0.56 weight percent, representative of a reaction product concentration of 0.11 weight percent.

The 1000 denier yarn was twisted, RFL-coated and made into peel test strips as in Example 42. The adhesion as measured by the peel force and visual ratings on the test pieces after pulling them apart at room temperature were 80.5 and 77.1 lbs/inch with visual ratings of 3.4 and 3.2. A yarn with no halohydroxy adhesive processed in the same manner gave adhesions of 35.9 and 33.9 lbs/inch with visual ratings of 2.1 and 2.1.

EXAMPLES 44–48

Example 13 was repeated in each of these Examples with the exception of the treating solution in the first stage. In Example 44 an acetone/water mixture (80/20 wt/wt) only was applied.

In Example 45 the solution contained 0.5 part potassium acetate and 1 part of a reaction product of one mole of 1,1,2,2-tetra-p-glycidoxyphenyl-ethane with four moles of 3-chloro-1-propanol in acetone/water 80/20 wt/wt. The reaction product had a measured percent epoxide of 0.05 weight percent (as epichlorohydrin), a hydroxyl value of 206.8 mgKOH/g and an undetected acid value. NMR confirmed the presence of the 3-chloropropyl ether group and showed only trace amounts of epoxy groups and 3-chloropropanol.

In Example 46–48 the acetone/water 80/20 wt/wt solution contained 0.5 parts potassium acetate and 1 part of a reaction product which is an ethoxylated version of the reaction product of Example 45 having 3, 6 and 9 moles of ethylene oxide added to 1 mole of the reaction product of Example 45, respectively. Measured properties of the reaction products of Examples 46–48 are shown below:

| Example | Hydroxyl Value (mg KOH/g) | % Total Chlorine | % NaCl | Acid Value (mgK)H/g |
|---|---|---|---|---|
| 46 | 173.6 | 9.7 | 0.03 | 0.74 |
| 47 | 148.9 | 8.05 | 0.07 | 0.59 |
| 48 | 130.9 | 7.25 | 0.07 | 0.41 |

Adhesion testing was performed as in Example 13 and the results are shown in Table XI.

TABLE XI

| Example | 75° F. Peel Test Pull Force (lbs/inch) | 75° F. Peel Test Visual Rating | Two Hour Steam Peel Test Pull Force (lbs/inch) | Two Hour Steam Peel Test Visual Rating |
|---|---|---|---|---|
| 44 | 20 | 1.4 | 12 | 1.0 |
| 45 | 22 | 1.8 | 14 | 1.2 |
| 46 | 30 | 2.8 | 20 | 1.8 |
| 47 | 27 | 2.8 | 17 | 1.7 |
| 48 | 48 | 3.6 | 22 | 2.2 |

These examples demonstrate that the architecture of the primary chloro functionality is not critical and that while a degree of surface modification can be achieved with secondary alcohols, the effect is markedly dependent upon the level of primary alcohols per molecule.

While the invention has been herein described in what is presently conceived to be preferred and exemplary embodiments thereof, those in the art may recognize that many modifications may be made thereof, which modifications shall be accorded the broadest scope of the appended claims so as to encompass all equivalent methods and products.

That which is claimed is:

1. A solid organic polymer containing on its surface a reaction product of a halohydroxy organic compound having primary halogen and hydroxyl functionalities, and a halohydrin value of less than or equal to 1.7% and an epoxy value of less than or equal to 0.36% and a cationic compound of an acid having a $pK_a > 2.5$.

2. The organic polymer of claim 1 wherein said organic polymer is selected from the group consisting of polyesters, polyimides, aromatic polyamides and graphitic polymers.

3. The organic polymer of claim 1 wherein said halohydroxy organic compound has at least one chlorine in a $—CH_2Cl$ group.

4. The organic polymer of claim 1 wherein said halohydroxy organic compound is selected from the group consisting of chlorinated ethers and thioethers.

5. The organic polymer of claim 6 wherein said halohydroxy organic compound is selected from the group consisting of oxy-w-dichloroalkylenes, w-trichloroalkylenes, thiochloropropylenes, oxychlorobutylenes, oxychloropropyl compounds, oxychloroalkyl compounds, polyoxychloropropylene polycarboxylic esters, and polythiochloropropylenes.

6. The organic polymer of claim 4 wherein said halohydroxy organic compound contains at least one oxychloropropylene group.

7. The organic polymer of claim 4 wherein said cationic compound is selected from the group consisting of alkali metal and quaternary ammonium hydroxides, carbonates, bicarbonates, carboxylates and nitrites.

8. The organic polymer of claim 7 wherein said polymer is a polyester in fiber form.

9. The organic polymer of claim 8 wherein said halohydroxy organic compound has at least one chlorine atom in a $—CH_2Cl$ group.

10. The organic polymer of claim 8 wherein said polyester is polyethylene terephthalate.

* * * * *